US007232196B2

(12) United States Patent
Kwon et al.

(10) Patent No.: US 7,232,196 B2
(45) Date of Patent: Jun. 19, 2007

(54) REFRIGERATOR

(75) Inventors: Yong-Choi Kwon, Changwon (KR); Kang-Chun Park, Bucheon (KR); Seon-Il Yu, Gwangmyeong (KR); Kun-Jun Seok, Seoul (KR); Kyeong-Seog Yun, Changwon (KR); Ji-Young Park, Seoul (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 10/954,177

(22) Filed: Oct. 1, 2004

(65) Prior Publication Data

US 2005/0073225 A1 Apr. 7, 2005

(30) Foreign Application Priority Data

Oct. 4, 2003 (KR) ..... 10-2003-0069034

(51) Int. Cl.
*A47B 96/00* (2006.01)

(52) U.S. Cl. ..... 312/402

(58) Field of Classification Search ..... 312/401, 312/402, 404, 405, 408, 330.1, 116; 62/382
See application file for complete search history.

(56) References Cited

U.S. PATENT DOCUMENTS 3,524,692 A * 8/1970 Preston ..... 312/322
3,734,588 A * 5/1973 Ellis ..... 312/247
5,308,158 A * 5/1994 Vogelgesang et al. ... 312/319.3
5,474,376 A * 12/1995 Saunders ..... 312/322

FOREIGN PATENT DOCUMENTS

| | | |
|---|---|---|
| DE | 2524962 | * 12/1976 |
| JP | 87-106894 | 7/1989 |
| KR | 87-17001 | 11/1987 |

* cited by examiner

*Primary Examiner*—James O. Hansen
(74) *Attorney, Agent, or Firm*—Birch, Stewart, Kolasch & Birch, LLP

(57) ABSTRACT

The present invention relates to a refrigerator. A refrigerator according to the present invention comprises a pair of fixed rails 12 installed on both side walls of inner surfaces of a storage space 11; a pair of movable rails 22 combined with the fixed rails so as to be drawn forward with respect to the fixed rails 12; a food storage container 30 supported on the movable rails 22; a linkage mechanism for moving the storage container 30 upward in a certain range; and a holding means for holding the storage container 30 at a position where the storage container has moved upward by the linkage mechanism. The linkage mechanism includes first and second links 40 and 50, both ends of each of which are pivotably connected to each movable rail 22 and to the storage container 30. According to the refrigerator of the present invention, it is easy to take foods in and out of the storage container of the storage space positioned at a lower position of the refrigerator.

24 Claims, 3 Drawing Sheets

REFRIGERATOR

This Non-provisional application claims priority under 35 U.S.C. § 119(a) on Patent Application No. 10-2003-0069034 filed in Korea, Republic of on Oct. 4, 2003, the entire contents of which are hereby incorporated by reference.

BACKGROUND OF THE INVENTION

1. Field of Invention

The present invention relates to a refrigerator, and more particularly, to a refrigerator which is configured such that a storage container can be lifted from its lower position to its upper position to allow foods to be easily taken in and out of the storage container for storing the foods therein.

2. Description of the Prior Art

FIG. 1 is shows a cross section of a portion of a refrigerator according to a prior art. Referring to the figure, a storage space 2 formed at an upper portion of the refrigerator is opened and closed by a door 4. A storage container 6 is installed in the storage space 2. The storage container 6 can pivot forward by means of guide levers 9 which are elastically supported to a fixed block 8 in one direction.

Thus, if a user draws the storage container 6 forward in a state where the door 4 positioned at the upper portion is opened, the storage container 6 comes down to a front lower position of the storage space 2 while pivoting about rear ends of the guide levers 9. If the storage container 6 is drawn forward as above, it is shifted from the upper position to the lower position. Thus, it is possible for the user to easily take the foods out of the storage container 6.

According to the prior art, it is easy to take the foods in and out of the storage container 6 by drawing down the storage container 6 in the storage space 2 positioned at the upper portion of the refrigerator.

However, the prior art does not disclose a structure for lifting up another storage container 6 positioned at the lower portion of the storage space 2. That is, in order to take foods in and out of a storage space provided at a lower portion of the refrigerator, the user should fully bend himself/herself forward. To bend himself/herself forward may cause lumbago and make it inconvenient to take foods in and out the storage container.

SUMMARY OF THE INVENTION

Accordingly, the present invention is conceived to solve the aforementioned problems in the prior art. An object of the present invention is to provide a refrigerator wherein foods can be easily taken in and out of a storage container of a storage space positioned at a lower portion of the refrigerator.

According to the present invention for achieving the objects, there is provided a refrigerator, comprising a pair of fixed rails installed on both side walls of inner surfaces of a storage space; a pair of movable rails combined with the fixed rails to be drawn forward with respect to the fixed rails; a food storage container supported on the movable rails; a linkage mechanism for moving the storage container upward in a certain range; and a holding means for holding the storage container at a position where the storage container has moved upward by the linkage mechanism.

The linkage mechanism is provided on each of both sides of the storage container and comprises: a first link with both ends connected to the movable rail and to a side of the storage container by pins, respectively; and a second link with both ends connected to the movable rail and to a side of the storage container by pins, respectively, the second link having a bent middle portion, and wherein the first and second links guide the lift of the storage container.

Preferably, the holding means comprises: a spring link with an end pivotably connected to the movable rail; and a spring with both ends connected to a front end of the spring link and to an intermediate portion of the second link, respectively.

More preferably, a handle is provided at an upper end of the storage container, and a user grips the handle and pivots the storage container.

Still more preferably, the present invention further comprising a door connected to front ends of the movable rails, the door being opened and closed in a drawer-like fashion.

Still more preferably, the present invention further comprising a door for selectively opening and closing the storage space, the door being provided separately from the movable rails.

According to the refrigerator of the present invention, there is an advantage in that the foods can be easily taken in and out of the storage container of the storage space positioned at a lower portion of the refrigerator.

BRIEF DESCRIPTION OF THE DRAWINGS

The above and other objects, features and advantages of the present invention will become apparent from the following description of a preferred embodiment given in conjunction with the accompanying drawings, in which.

DETAILED DESCRIPTION OF THE PREFERRED EMBODIMENT

Hereinafter, a preferred embodiment of a refrigerator according to the present invention will be described in detail with reference to the accompanying drawings.

Figure 1:
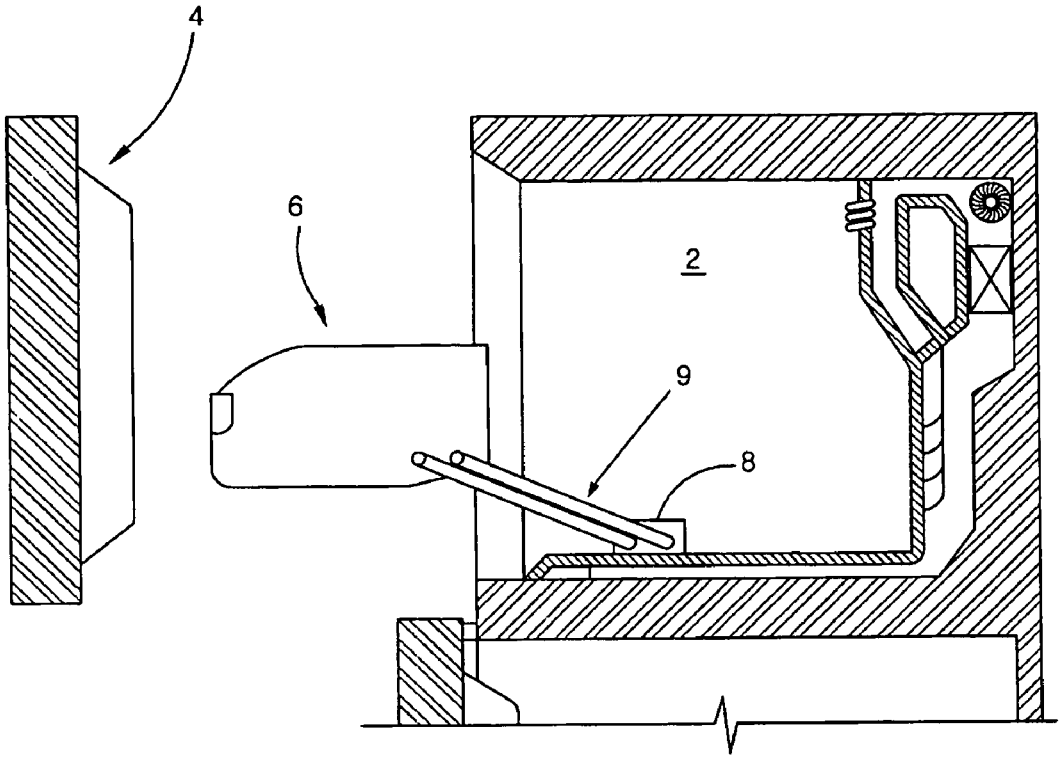
FIG. 1 Related Art
FIG. 1 is a sectional view showing a major portion of a refrigerator according to a prior art.
Figure 2:
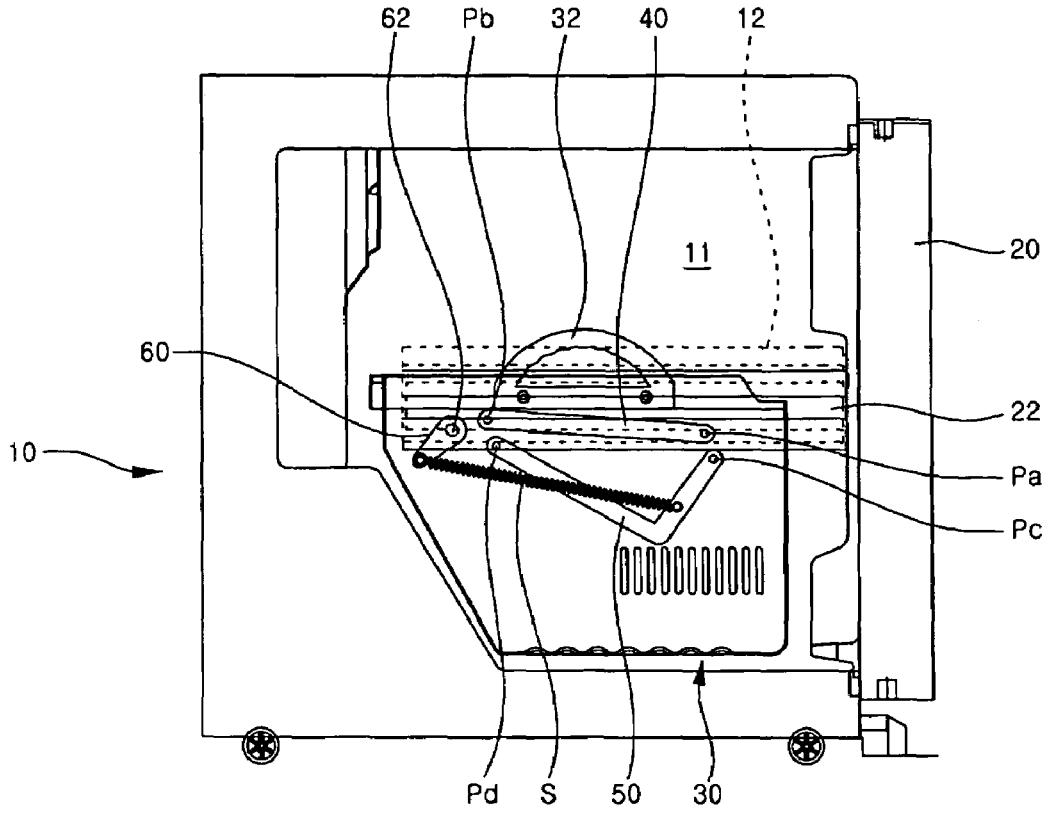
FIG. 2 is a sectional view showing a preferred embodiment of a refrigerator according to the present invention.

FIG. 2 shows a cross section of the preferred embodiment of the refrigerator according to the present invention. Referring to the figure, a refrigerator main body 10 is formed with a storage space 11. The storage space 11 to which the present invention is applied is provided in a lower portion of the refrigerator main body 10. Concretely, the storage space 11 is formed at a position lower than that of the waist of a user. For reference, FIG. 2 shows only the lower portion of the refrigerator main body 10 for convenience.

Fixed rails 12 are installed on both side walls of inner surfaces of the storage space 11, respectively. The fixed rails 12 functions to guide a storage container 30, which will be described bellow, to move into and out of the storage space 11.

A door 20 functions to selectively open and close the storage space 11. The door 20 is installed on a front surface of the refrigerator main body 10. In the present embodiment, the door 20 comes into close contact with the front surface of the refrigerator main body 10 in order to close the storage space 11, and is drawn to the front of the refrigerator main body 10 in order to open the interior of the storage space 11. That is, the door 20 is opened and closed in a drawer-like fashion.

The door 20 of the present embodiment opened and closed in the drawer-like fashion is provided with movable rails 22 which move along the fixed rails 12. The respective movable rails 22 are extended rearward from a rear surface of the door 20. The movable rails 22 are provided on the door 20 to correspond to the fixed rails 12 provided on both the side walls of the inner surfaces of the storage space 11, respectively. The movable rails 22 are combined with the fixed rails 12 and thus supported thereby to be translated back and forth.

The storage container 30 is provided between the pair of the movable rails 22. A space for storing foods is provided in the storage container 30. A handle 32 which the user grips is installed on an upper end of the storage container 30. As described bellow, the handle 32 is a portion which the user grips by his or her hand when pivoting the storage container 30 relatively upward.

The storage container 30 is pivotably supported on the movable rails 22 by a linkage mechanism. The linkage mechanism is preferably provided at each of both side surfaces of the storage container 30, respectively.

First, an end (i.e., the right end in the figure) of each first link 40 of a linear shape is pivotably connected to each of both the side surfaces of the storage container 30 by a pin Pa. The other end (i.e., the left end in the figure) of the first link 40 is pivotably connected to a rear end of each of the movable rails 22 by a pin Pb.

In addition, an end (i.e., the right end in the figure) of each second link 50, the middle portion of which is bent at a certain angle as an 'L' shape, is connected to the storage container 30 by a pin Pc. The other end (i.e., the left end in the figure) of the second link 50 is pivotably connected to each of the movable rails 22 by a pin Pd.

Therefore, with respect to the pins Pb and Pd as supporting points connected to the movable rails 22, the storage container 30 is installed movably upward, and thus, can substantially pivots counterclockwise in the figure within a certain range. The pivoting of the storage container 30 counterclockwise about the pins Pb and Pd as the supporting points means that the storage container 30 can move upward. That is, the storage container 30 moves in a circular arc within the certain range. It is noted that such a motion is supported by the first and second links 40 and 50.

A portion of the movable rail 22 is provided with a spring link 60. The spring link 60 is installed to the movable rail 22 pivotably about a supporting shaft 62 (for example, by means of the pin connection). An end (i.e., the left end in the figure) of a spring S is connected to a front end of the spring link 60. The right end of the spring S is connected to an intermediate portion of the second link 50 the middle portion of which is bent.

The spring S generates an elastic force to allow the storage container 30 to stay at a specific position according to the rotated positions of the second link 50 and the spring link 60. That is, the spring S provides the elastic force so that the storage container 30 is held in a lower or upper position.

Hereinafter, the operation of the refrigerator according to the present invention so constructed will be described in detail.

In order to open the storage space 11 positioned at the lower portion, the user should draw the door 20 forward. If the door 20 is drawn forward, the movable rails 22 connected thereto slide in the fixed rails 12 and are also drawn forward. Then, according as the movable rails 22 are drawn forward, the storage container 30 is also drawn forward.

If the door 20 opens the storage space 11, the handle 32 is exposed so that the user may grip it. Therefore, the storage container 30 is ready to pivot upward. In such a state, the user can draw the storage container 30 upward using the handle 32. If the storage container 30 is drawn upward, the first and second links 40 and 50 pivot about the pins Pb and Pd positioned at the left ends. Therefore, the pins Pa and Pc positioned at the right ends of the first and second links 40 and 50 move upward. It means that the storage container 30 pivots counterclockwise and moves upward.

Figure 3:
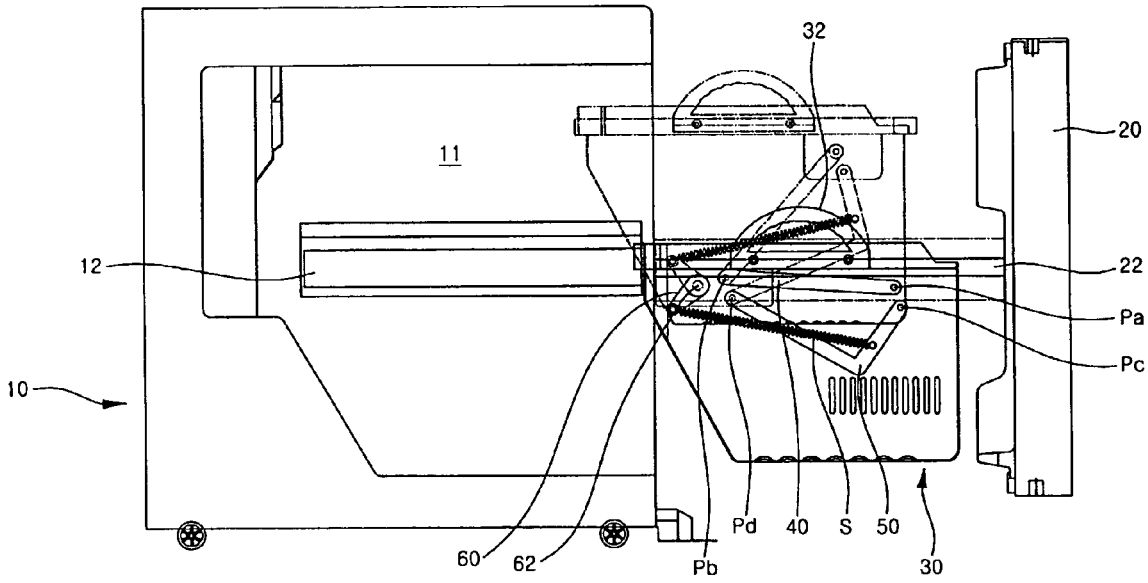
FIG. 3 is a view showing the operation of the embodiment according to the present invention.

In FIG. 3, the storage container 30, the first link 40, and the second link 50 which are represented by dashed dot lines show that the storage container 30 pivots counterclockwise and moves to its most upper position. At this time, during the process that the storage container 30 moves to the upper position, the first and second links 40 and 50 also pivot counterclockwise about the pins Pb and Pd positioned at the left side. Here, the spring link 60 connected to the intermediate portion of the second link 50 through the spring S also pivots with respect to the supporting shaft 62.

In the pivoting process, when the spring S is nearly in a horizontal state, the spring S is most stretched and thus generates the largest elastic force. In such a state, if the storage container 30 moves more upward, the length of the spring S is reduced and has a certain elastic force. That is, the spring S connected to the second link 50 draws the second link 50, and thus, generates the elastic force causing the second link 50 to pivot counterclockwise about the pin Pd. Since such an elastic force of the spring S operates as a force that substantially draws the second link 50 to the left side about the pin Pd, a state where the first and second links 40 and 50 has fully pivoted counterclockwise is held. Thus, the state where the storage container 30 has fully pivoted upward (i.e., counterclockwise) by the first and second links 40 and 50 can be held.

In the state where the storage container 30 may be relatively lifted up as described above, the storage container 30 should move to its original position after the foods are taken in or out from the container 30. The process of moving the storage container 30 to its lower position (represented by solid lines in the figure) by pivoting the container clockwise is performed inversely to the aforementioned process.

That is, if the storage container 30 pivots downward by using the handle 32, while pivoting clockwise about the pins Pb and Pd, the first and second links 40 and 50 guide the storage container 30 downward. In addition, in a state where the storage container 30 has fully come down, the spring S generates the force that draws the second link 50 to the left side and makes the state be held. Thus, it is possible for the storage container 30 to be substantially held in the state represented by solid lines.

In the meantime, although not shown in the figures, another modification to the present invention will be described.

In aforementioned embodiment, the door 20 is drawn forward in the drawer-like fashion, and the movable rails 22 are interconnected with the door 20 such that they can be drawn forward. However, the door 20 may be employed in the present invention so long as it is configured to open and close the storage space 10 in the refrigerator. For example, it is possible to employ a general door which is opened and closed through hinges.

That is, the movable rails 22 movably supported to the fixed rails 12 operate separately from the door 20, and the storage container 30 is supported by the linkage mechanisms on the movable rails 22. In such a structure, an operation for drawing the storage container 30 forward by using the movable rails 22 should be separately performed.

According to the refrigerator of the present invention as described above, the following advantages can be expected.

The present invention is configured so that the storage container installed in the storage space formed at the lower portion of the refrigerator is lifted up by a certain height and then foods may be taken in or out of the storage container.

Therefore, since the user need not bend the body when the foods stored at the lowest portion of the refrigerator are taken in or out, the advantage of convenience in use can be expected.

The scope of the present invention is not limited to the embodiment described and illustrated above but is defined by the appended claims. It will be apparent that those skilled in the art can make various modifications and changes thereto within the scope of the fundamental technical spirit of the present invention as described above. In addition, the true scope of the present invention should be defined on the basis of the appended claims.

What is claimed is:

1. A refrigerator, comprising:

a pair of fixed rails installed on both side walls of inner surfaces of a storage space;

a pair of movable rails combined with the fixed rails to be drawn forward with respect to the fixed rails;

a food storage container supported on the movable rails;

a linkage mechanism for moving the storage container upward in a certain range; and holding means for holding the storage container at a position where the storage container has moved upward by the linkage mechanism, the holding means for each of the movable rails including:

a spring link connected to and pivotable on the corresponding movable rail, the spring link having a movable end; and a spring with a first end and a second end, the first end of the spring being pivotably connected to the movable end of the spring link, the second end of the spring being connected to the linkage mechanism.

2. The refrigerator as claimed in claim 1, wherein the linkage mechanism is provided on each of both sides of the storage container and comprises:

a first link with a first end and a second end, the first end of the first link being connected to the movable rail by a first pin, the second end of the first link being connected to a side of the storage container by a second pin; and a second link with a first end and a second end, the first end of the second link being connected to the movable rail by a third pin, the second end of the second link being connected to a side of the storage container by a fourth pin, wherein the first and second links guide the lift of the storage container.

3. The refrigerator as claimed in claim 2, wherein the second link has a first straight portion and a second straight portion, the first straight portion starting from the first end of the second link, the second straight portion starting from the second end of the second link, the first straight portion and the second straight portion forming a non-straight angle at a junction of the first portion and the second portion.

4. The refrigerator as claimed in claim 3, wherein the second end of the spring is connected to the second straight portion between the junction and the second end of the second link.

5. The refrigerator as claimed in claim 3, wherein the non-straight angle is an obtuse angle.

6. The refrigerator as claimed in claim 1, further comprising:

a handle at an upper end of the storage container for a user to grip the handle to pivot the storage container; and a door spaced apart from the storage container.

7. The refrigerator as claimed in claim 1, further comprising a door connected to front ends of the movable rails, the door being opened and closed along a horizontal direction.

8. The refrigerator as claimed in claim 1, further comprising a door for selectively opening and closing the storage space, the door being provided separately from the movable rails.

9. The refrigerator as claimed in claim 1, wherein the storage space is located in a lower portion of a main body of the refrigerator.

10. The refrigerator as claimed in claim 1, wherein the food storage container is located at a first position when the movable rails move forward with respect to the fixed rails, and the linkage mechanism is for moving the storage container upward from the first position in the certain range.

11. The refrigerator as claimed in claim 1, wherein the first end of the spring moves from a first position to a second position when the storage container is moved upward, the first position being different from the second position.

12. The refrigerator as claimed in claim 1, wherein the spring link is a rigid member.

13. The refrigerator as claimed in claim 1, wherein the spring link is located and pivotable at the corresponding movable rail.

14. The refrigerator as claimed in claim 1, wherein the spring link is located and pivotable about a horizontal shaft.

15. A refrigerator, comprising:

a pair of fixed rails installed on both side walls of inner surfaces of a storage space;

a pair of movable rails combined with the fixed rails to be drawn forward with respect to the fixed rails;

a food storage container supported on the movable rails;

a linkage mechanism for moving the storage container upward in a certain range, wherein the linkage mechanism is provided on each of both sides of the storage container and includes a link to guide lift of the storage container, the link being pivotable on a pivot point on the movable rail; and holding means for holding the storage container at a position where the storage container has moved upward by the linkage mechanism, the holding means for each of the movable rails including:

a spring link connected to and pivotable on the corresponding movable rail, the spring link having a movable end;

a spring with a first end and a second end, the first end of the spring being pivotably connected to the movable end of the spring link, the second end of the spring being connected to the link of the link mechanism, the spring moving from a first position to a second position when the storage container is moved upward, the pivot point of the link being located between the first position and the second position.

16. The refrigerator as claimed in claim 15, further comprising:

a handle at an upper end of the storage container for a user to grip the handle to pivot the storage container; and a door spaced apart from the storage container.

17. The refrigerator as claimed in claim 15, further comprising a door connected to front ends of the movable rails, the door being opened and closed along a horizontal direction.

18. The refrigerator as claimed in claim 15, further comprising a door for selectively opening and closing the storage space, the door being provided separately from the movable rails.

19. The refrigerator as claimed in claim 15, wherein the link has a first end and a second end, the first end of the link being connected to the movable rail at the pivot point, the second end of the link being connected to a side of the storage container, wherein the linkage mechanism further includes a second link with a first end and a second end, the first end of the second link being connected to the movable rail at a second pivot point, the second end of the second link being connected to a side of the storage container, the second pivot point being located between the first position and the second position.

20. The refrigerator as claimed in claim 15, wherein the spring moves from a first position to a second position to cross the pivot point when the storage container is moved upward.

21. The refrigerator as claimed in claim 15, wherein the spring link is a rigid member.

22. The refrigerator as claimed in claim 15, wherein the spring link is located and pivotable at the corresponding movable rail.

23. The refrigerator as claimed in claim 15, wherein the spring link is located and pivotable about a horizontal shaft.

24. A refrigerator, comprising:

a pair of fixed rails installed on both side walls of inner surfaces of a storage space;

a pair of movable rails combined with the fixed rails to be drawn forward with respect to the fixed rails;

a food storage container supported on the movable rails;

a linkage mechanism for moving the storage container upward in a certain range; and holding means for holding the storage container at a position where the storage container has moved upward by the linkage mechanism, the holding means for each of the movable rails including:

a spring link connected to and pivotable on the corresponding movable rail, the spring link having a movable end; and a spring with a first end and a second end, the first end of the spring being connected to the movable end of the spring link, the second end of the spring being connected to the linkage mechanism;

wherein the linkage mechanism is provided on each of both sides of the storage container and comprises:

a first link with a first end and a second end, the first end of the first link being connected to the movable rail by a first pin, the second end of the first link being connected to a side of the storage container by a second pin; and a second link with a first end and a second end, the first end of the second link being connected to the movable rail by a third pin, the second end of the second link being connected to a side of the storage container by a fourth pin, wherein the first and second links guide the lift of the storage container, and wherein the second link has a first straight portion and a second straight portion, the first straight portion starting from the first end of the second link, the second straight portion starting from the second end of the second link, the first straight portion and the second straight portion forming a non-straight angle at a junction of the first portion and the second portion.

* * * * *